United States Patent [19]

Haglund et al.

[11] 4,454,634

[45] Jun. 19, 1984

[54] SAFETY BELT BUCKLE

[75] Inventors: Lennart Haglund; Sigvard Johansson, both of Vårgårda, Sweden

[73] Assignee: AB Stil-Industri, Vårgårda, Sweden

[21] Appl. No.: 355,557

[22] PCT Filed: Jun. 15, 1981

[86] PCT No.: PCT/SE81/00178

§ 371 Date: Feb. 10, 1982

§ 102(e) Date: Feb. 10, 1982

[87] PCT Pub. No.: WO81/03603

PCT Pub. Date: Dec. 24, 1981

[30] Foreign Application Priority Data

Jun. 16, 1980 [SE] Sweden ..... 8004462

[51] Int. Cl.[3] ..... A44B 11/25

[52] U.S. Cl. ..... 24/636; 24/645; 24/664

[58] Field of Search ..... 24/230 A, 230 AV, 230 AK, 24/230 AL, 230 AT

[56] References Cited

U.S. PATENT DOCUMENTS

| | | | |
|---|---|---|---|
| 4,069,559 | 1/1978 | Weman | 24/230 A |
| 4,096,606 | 6/1978 | Stephenson | 24/230 A |
| 4,182,008 | 1/1980 | Pouget | 24/230 A |
| 4,206,533 | 6/1980 | Meiller | 24/230 AK |
| 4,353,151 | 10/1982 | Ennerdal | 24/230 A |

*Primary Examiner*—Gene Mancene
*Assistant Examiner*—Kris R. Schulze

[57] ABSTRACT

A safety belt buckle fitted with belt straps and two interlocking parts. These are designed for releasably connecting the belt strap. One interlocking part consists of a locked part and the other interlocking part consists of a locking part. The latter is fitted with a locking member pivoted in the locking part and able to be reset between the position releasing and the position locking the locked part. The locking member is spring loaded so as to attempt to pivot to its releasing position. A detent member is able to be reset between a detent position in which the locking member is prevented from being reset from its locking position and a releasing position in which the locking member is permitted to pivot to its releasing position. An ejector is arranged so as to eject the locked part by the action of a spring when the locking member is rest to the locking position. A link connects the detent member to the ejector. The link is loaded by a spring which attempts to move the ejector to its outer position. When the ejector is pushed in by means of the locked part it brings with it the detent member away from its releasing position. By the action of the spring the detent member is moved to the locking position. When moved from its locking position the detent member is moved to its releasing position and the ejector is moved to its outer position by the action of the spring.

3 Claims, 5 Drawing Figures

SAFETY BELT BUCKLE

BACKGROUND OF THE INVENTION

Safety belts with buckles of the type indicated in the introduction to claim 1 are described, e.g. in the Swedish Patent Application No. 7704854-4. This known mechanism includes a detent member movable in the direction of entry of a locking tongue forming part of the device while a pivoting locking member is constructed in such a way that the locking member may be pivoted to a release position when the detent member is moved in the direction mentioned. The locking member then presents an edge which must be passed, there then being a risk of the detent member catching on this edge leading to partial locking. Partial locking is a very difficult problem to overcome when designing safety belt buckles, and is a very essential problem as partial locking may mean that the two interconnecting buckle parts are separated under loads on the safety belt, e.g. in an accident.

SUMMARY OF THE INVENTION

The purpose of the present invention is to eliminate the risk of partial locking and to arrive at a buckle which is simple to manufacture and which meets stringent requirements of operation, durability, etc.

The invention accordingly provides safety belts including a lockable buckle part and a locking buckle part, the locking buckle part comprising a locking member pivoted in the locking buckle part for movement between a releasing position releasing the lockable buckle part, and a locking position locking the lockable buckle part the locking member being spring-biased to the releasing position thereof; a detent member movable between a latching position to retain the locking member in the locking position thereof, and a releasing position to allow the movement of the locking member to the releasing position thereof; a spring-biased ejector for ejecting the lockable buckle part when the locking member is moved to the releasing position thereof, said ejector being arranged to be moved by the lockable buckle part, thereby to move the detent member from the releasing position thereof; a pivoted linking arm operatively connected at one end to the detent member and at the other end to the ejector and biased by a spring arranged to bring the detent member by the intermediary of the linking arm to the locking position thereof upon connection of the lockable buckle part with the locking buckle part, and to the releasing position upon moving the detent member from the latching position thereof.

BRIEF DESCRIPTION OF THE VIEWS OF THE DRAWINGS

The invention will be described below through a realized example, with reference to appended drawings, in which.

DETAILED DESCRIPTION OF THE INVENTION WITH PARTICULAR REFERENCE TO THE DRAWINGS

Figure 1:
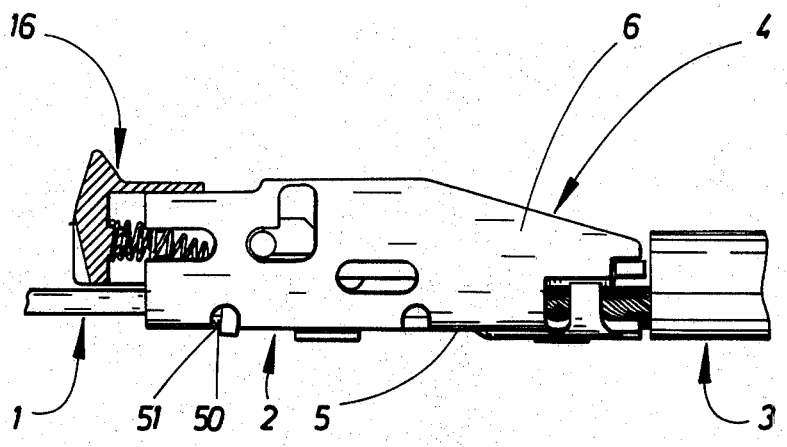
FIG. 1 shows a side view of the buckle according to the invention in the locking position.

The buckle according to the invention is constructed of two interconnecting parts, i.e. one locked and one locking part, consisting of a locking tongue 1 and a locking device 2, respectively. The locking tongue 1 is normally attached to a belt strap and may, for example, be constructed with a slot (not shown) through which the belt strap runs and which redirects the belt strap between the safety belt hip strap and the chest strap as in the case of so called three-point belts. In the example shown the locking device is anchored to a fixed part of e.g. a vehicle, such as the floor or the propeller shaft tunnel by means of a pulling member 3 which in the example shown is constructed as a wire rope loop. This loop should be sufficiently rigid to support the locking device and flexible enough to adopt the desired direction when the buckle is being connected.

The locking device 2 is constructed of a housing 4 made e.g. of metal and having a channel shaped cross section, i.e. it has a bottom 5 and two identical side walls 6. The locking device 2 is enclosed in a cover 7 suitably constructed from an easily moulded material such as plastic, only indicated in FIGS. 4 and 5 and having an entrance, not shown, for the locking tongue 1. Through this entrance the locking tongue may be inserted into the locking device along a path at the bottom 5 of the housing 4 and is able to be locked in a manner to be described below. For this purpose the locking device includes a locking member 9 the construction of which according to the example shown can best be seen from FIG. 3. The locking member has at the front two downward pointing locking hooks 10 and at the back two sideways pointing bearing bosses 11 arranged to interact with the backward pointing bearing faces 12 of the slots 13, one in each side wall 6. In addition, the locking member has a tongue 14 at the front forming a carrier for a compression spring 15 the primary task of which is to hold the buckle trigger 16 in the outward position. The locking member 9 also has a central slot 17 through which in certain positions a compression spring 18 is designed to extend in a manner to be more fully described below. At this slot 17 there is a tongue shaped mounting 19 for the compression spring 18. At the back, the locking member 9 also has a circular slot 20 designed to accommodate a load absorbing peg 21 fixed to the housing 4. The circular slot 20 should preferably have a diameter slightly exceeding the diameter of the peg 21 and it should be so positioned that in the released buckle condition, some clearance is produced between the slot faces and the peg 21. As best can be seen from FIGS. 4 and 5 the locking members 9 will be supported on the plain face 22 of a bush 23 enclosing the peg 21. This bush has an appropriately rounded groove 24 in which the wire rope loop 25 is accommodated.

Figure 3:
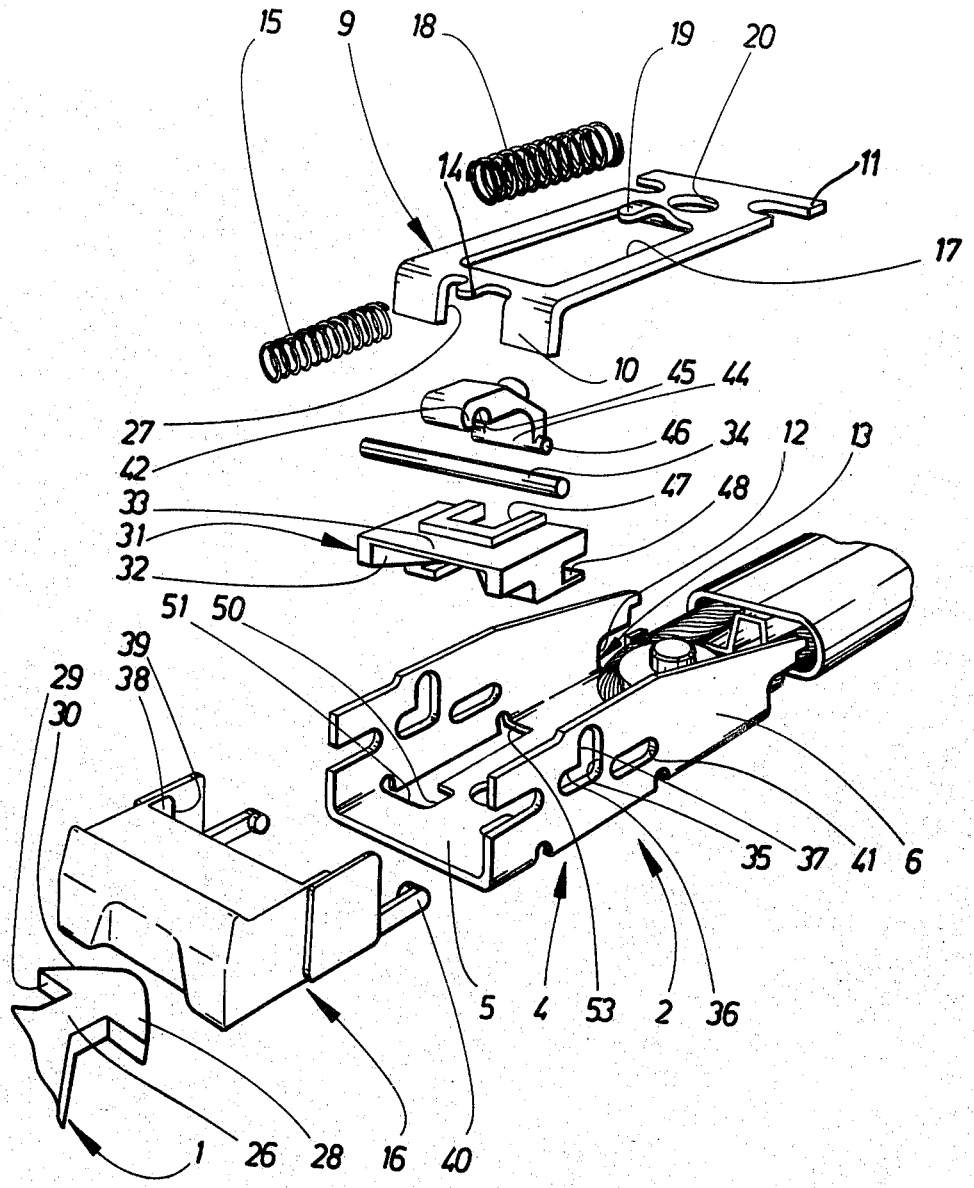
FIG. 3 shows an exploded view of the buckle.
Figure 4:
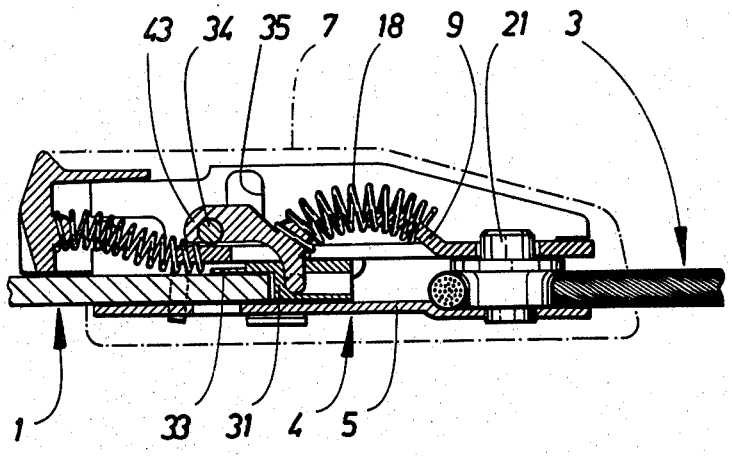
FIG. 4 shows a central longitudinal section of the buckle in the locking position.
Figure 5:
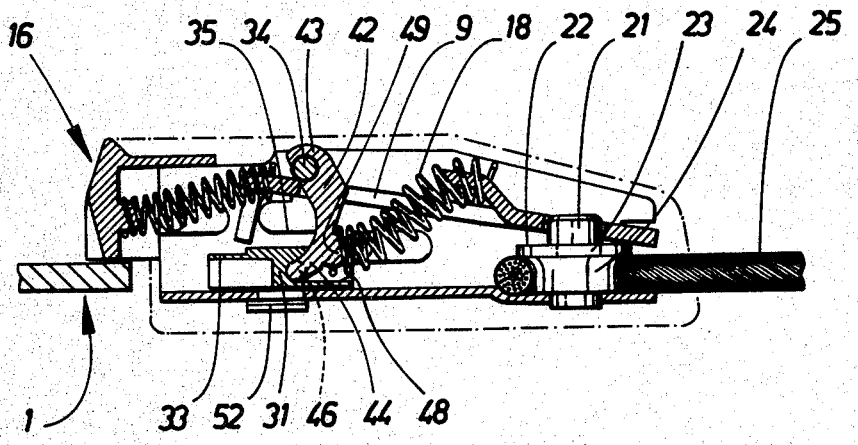
FIG. 5 shows a corresponding section of the buckle in the release position.

It can be seen from FIGS. 3, 4 and 5 how the locking member 9 is intended to interact with the locking tongue 1. In the locking position the locking member 9 projects downwards into the path of the locking tongue 1 along the bottom 5 of the housing 4 causing the two locking hooks 10 of the locking member to project downwards on each side of the neck 26 of the locking tongue projecting into slot 27 in the locking member. The locking hooks 10 project downwards into slots 50 in the bottom, the slots having front, backward pointing load absorbing stop faces 51. The locking tongue is, as known per se, fitted with a head 28 having backward facing stop faces 29 interacting with the locking hooks 10 of the locking member 9. The head of the locking tongue has a rounded end 30 arranged to interact with an ejector 31 movable in the locking device in the direction of movement of the locking tongue 1 and loaded against the locking tongue's direction of entry by means of the compression spring 18. The ejector 31 may be constructed e.g. from an easily moulded material such as plastic and is thus able to move between an outer position which it occupies when the locking tongue is released from the locking device (see FIG. 1) and an inner position occupied by the action of the locking tongue working against the compression spring 15 (see FIG. 4). The ejector 31 has a slot 32 of a shape corresponding to the front end 30 of the locking tongue 1, arranged to accommodate the end mentioned. A guard 33 in the ejector 31 prevents the locking tongue from being accidentally inserted incorrectly into the locking device. The further construction of the ejector and its interaction with the internal locking mechanism is described below in greater detail.

The locking device further includes a detent member which in the example shown is constructed as a bar and, therefore, hence called detent bar 34. The detent bar extends through two guide slots 35, one in each side wall 6, and is able to move along a path determined by the design of the slots. As best can be seen from FIG. 1 each slot is designed with one part 36 extending basically parallel to the path of the locking tongue, and with another part 37 extending away from the path of the locking tongue along the bottom 5 of the housing 4. The extension of part 37 thus intersects the path of the locking tongue or its extension. Thus, slots 35 are angular.

The detent bar 34 is controlled by a trigger 16 accessible from the outside through an aperture (not shown) in the cover 7. The trigger is movable in the longitudinal buckle direction, i.e. the direction of entry of the locking tongue 1, and has two lateral sections 38 arranged to strike the detent bar 34 with its striking faces 39 when the trigger is pushed in. As stated earlier the trigger 16 is spring loaded by means of the compression spring 15 which being supported on the locking member 9 thus provides the return force for the trigger for the purpose of moving it to its outer position after the trigger has been pushed in. The trigger 16 has two end position limiters 40 consisting of pegs running in slots 41 in the two side walls 6 of the housing 4. The end position limiters 40 also contribute to stabilizing the trigger in its movements.

According to the present invention the buckle locking mechanism has a link 42 one end 43 of which is connected to the detent bar and the other end 44 connected to the ejector 31. As can be seen from FIG. 3 the link 42 has at one end a groove 45 designed to retain the detent bar by snap action. The lower end 44 of the link 42 is constructed as a lower pivot axle 46 with lateral journals. The link is designed to extend downwards through a slot 47 in the ejector 31 and to project its lateral journals 46 forming the lower pivot axle into a groove 48 in the ejector 31, this groove opening backwards. By this arrangement the link 42 forms a pivoting unit designed to pivot round two pivot axles, one at each end, the detent bar 34 forming the upper pivot axle. The movement of the link 42, however, does not solely consist of pivoting movements but the two pivot axles are arranged so as to move along predetermined paths. The lower pivot axle is arranged basically to move linearly forwards and backwards along the entry path of the locking tongue 1 while the movement of the upper pivot axle is determined by the extension of the angular slots 35. Between the two pivot axles of the link 42 there is a projection 49 forming the forward fixing point of the compression spring 18 which at the opposite end is attached to the locking member 9 by its tongue shaped projection 19. Thus, the compression spring 18 applies a compressive force to the link, utilized to move the detent bar 34 as well as the ejector 31 in a way to be described in greater detail below.

Figure 2:
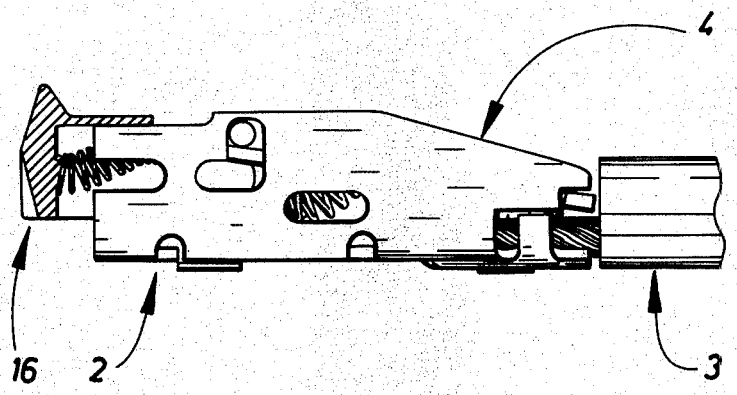
FIG. 2 shows a corresponding view of the buckle according to the invention in the release position.

The buckle according to the invention operates as follows. When the two interconnecting parts of the buckle are disconnected, i.e. when the locking tongue 1 is removed from the locking device 2, the locking device is in the releasing position as shown in FIGS. 2 and 5. This position is occupied when the belt is not in the operating position but is disconnected and the belt strap is pulled in by means of a (not shown) reeling device which, as known per se, is arragned to lock at abnormal vehicle speed variations. The belt may also be of a so called static type lacking a reeling device. In the releasing position of the locking device 2 the detent bar 34 is in the releasing position, i.e. at the outer end of part 37 of the guide slots 35 extending across the path of the locking tongue 1. As can be seen from FIG. 5 the releasing position of the detent bar 34 is ensured by maintaining a predetermined distance between the two pivot axles of the comparatively rigid link 42 and by the fact that the ejector 31 is, in the forward position, defined by the ejector striking the stop faces 51 of the slots 50. The ejector runs on bottom guide flanges 52 in the slots 50 and has definite end positions determined by the forward and rear stop faces 51 and 53. Thus, these positions will be occupied by the action of the compression spring 18. At the same time the compression spring 18 provides the force acting to keep the locking member 9 in the releasing position, i.e. the upward tilted position.

When the locking tongue 1 is inserted along its path of entry along the bottom 5 of the housing 4 and the front end 30 of the head 28 enters the recess 32 in the ejector 31 the ejector will be pushed in further into the locking device 2 along the entry path against the action of the compression spring 15. Through the linear movement along the entry path of the lower pivot axle 46 the link 42 is made to pivot round the lower pivot axle 46 as well as round the upper pivot axle, i.e. the detent bar 34. Due to the fixed distance between the two pivot axles the detent bar 34 will be pulled downwards along section 37 of the slot 35 pulling with it the locking member 9, and when the locking tongue 1 has entered far enough to have passed its locking position, i.e. the backward facing stop face 29 of the locking tongue has passed the locking position of the locking hooks 10 of the locking member, the locking member has been tilted downward so far that its locking hooks protrude into the locking tongue's path of entry. During the downward pulling of the detent bar 34 it is, through the link 42, exposed to spring action in the left hand direction in FIG. 5 by the compression spring 18. The result is that, when the detent bar 34 has been pulled down to a position opposite the longitudinal section 36 of slot 35, the detent bar will be pushed forward in this section of the slot while the link 42 pivots round its lower pivot axle 46 to the locking buckle position shown in FIG. 4. During this movement the ejector 31 and the locking tongue 1 are allowed to return some distance outward under the effect of the compression spring 15 so that the backward facing stop faces 29 of the locking tongue 1 contact the locking hooks 10. The buckle will then be in such a position that it is able to transfer the required load from the belt strap through the locking tongue and to the anchoring member 3. This is achieved through the backward facing stop faces 29 of the locking tongue and the looking hooks 10 of the locking member 9 and through the faces of slot 20 in the locking member, the peg 21 and to the anchoring member 3. The housing 4 also plays its part in the load absorption by the peg 21 being fixed, for instance, by being riveted to the bottom 5 of the housing and by the locking hooks 10 of the locking member 9 being pulled forward into contact with the housing stop faces 51 under load, preventing straightening of the locking hooks. The spring loading by means of the compression spring 15 ensures the existence of a certain clearance between the locking hooks 10 and the stop faces 50 under no-load conditions as well as a clearance at the peg 21, resulting in a satisfactorily operating and easily controlled mechanism, no extremely strict manufacturing tolerances having to be met.

To release the locking tongue 1 from the locking device 2 of the buckle the trigger 16 is actuated by being pushed inwards, e.g. with the aid of the thumb, against the action of the compression spring 15, bringing the guide faces 39 of the trigger into contact with the ends of the detent bar 34, this bar being moved along the longitudinal section 36 of slot 35 and carrying with it also the link 42 and possibly also the ejector 31 against the action of the compression spring 18. By the action of the force of the compression spring 18 against the locking member 9 the locking member continuously attempts to pivot upwards to the releasing position; this pivoting upwards will be allowed as soon as the detent bar is positioned opposite the transverse section 37 of slot 35. By means of suitably adjusted moment arms it is ensured that the force ratios are such that the locking member 9 exerts such a force upon the detent bar 34 that the bar will be pushed upwards along the transverse section 37 of slot 35, the lower end 44 of the link 42 being moved forward by the effect of the compression spring 18 and moving the ejector 31 in the inward direction along the path of entry. Previously the locking hooks 10 of the locking member 9 have been moved out of the entry path releasing the locking tongue 1 to be ejected, an operation achieved by the ejector's 31 moving to its forward end position shown in FIG. 5. After pressing the trigger 16 it will immediately return to its outer end position by the action of the compression spring 15.

The invention is not limited to the realized example described above and shown in the drawings but may be varied in a number of ways within the scope of the claims. For instance, it is possible for slot 35 not to be angular but sloping relative to the direction of the path of entry. The compression spring 18 for the trigger 16, for instance, may be supported by a section of the cover 7 instead of by the locking member 9. In certain cases, in order to permit correct paths of movement, it may be possible to construct a flexible or in some way hinged link. Also, the locking tongue may be a holed tongue having a central slot instead of an arrow-shaped tongue, the two locking hooks 10 of the locking member being replaced by a single locking detail symmetrically positioned.

We claim:

1. Buckle for safety belts including a lockable buckle part and a locking buckle part, the locking buckle part comprising a locking member pivoted in the locking buckle part for movement between a releasing position releasing the lockable buckle part, and a locking position locking the lockable buckle part, the locking member being spring-biased to the releasing position thereof; a detent member movable between a latching position to retain the locking member in the locking position thereof, and a releasing position to allow the movement of the locking member to the releasing position thereof; a spring-biased ejector for ejecting the lockable buckle part when the locking member is moved to the releasing position thereof, said ejector being arranged to be moved by the lockable buckle part so as to move the detent member from the releasing position to the latching position thereof; and a pivoted linking arm pivotally connected at one end to the detent member and pivotally connected at the other end to the ejector and biased by a spring attached to the linking arm and is arranged to bring the detent member, to the latching position thereof upon connection of the lockable buckle part with the locking buckle part and to the releasing position upon movement of the detent member from the latching position thereof.

2. Buckle according to claim 1, in which the spring comprises a compression spring mounted between the locking member and the linking arm to bias the locking member to the releasing position thereof.

3. Buckle according to claim 1, in which the detent member comprises a bar pivotally mounted to a first end of the linking arm and displaceable along an angled path with one portion of the angled path extending along the path for insertion of the lockable buckle part, and a section extending away from said first mentioned portion, and the linking arm pivotally mounted in the ejector at a second end thereof, the spring being engaged with the linking arm at a location between the ends of the linking arm.

* * * * *